US005295595A

United States Patent [19]

Gobidas et al.

[11] Patent Number: 5,295,595

[45] Date of Patent: Mar. 22, 1994

[54] REINFORCED FOAM DRAPERY HARDWARE

[75] Inventors: Raphael A. Gobidas; Natalie C. Salvatore, both of Cleveland, Ohio

[73] Assignee: Artizana Drapery Hardware, Inc., Cleveland, Ohio

[21] Appl. No.: 715,476

[22] Filed: Jun. 14, 1991

[51] Int. Cl.[5] ..... A47H 1/02

[52] U.S. Cl. ..... 211/105.1; 211/105.2; 160/330

[58] Field of Search ..... 211/105.1, 105.2, 105.6; 135/104; 223/98, 105; 160/330, 134; 16/95 D, 96 D; 47/47.12; 248/27.8

[56] References Cited

U.S. PATENT DOCUMENTS

| | | | |
|---|---|---|---|
| D. 113,930 | 3/1939 | Lange | 160/330 |
| 1,813,556 | 2/1931 | Young | 211/105.1 |
| 2,401,212 | 5/1946 | Wilson | 211/105.1 X |
| 3,537,625 | 11/1970 | Nuttall | 211/113 X |
| 3,762,097 | 10/1973 | Gallo | 211/105.6 X |
| 3,847,314 | 11/1974 | Florian | 223/98 |
| 4,496,059 | 1/1985 | Leiter | 211/105.1 |
| 4,742,926 | 5/1988 | Mather | 211/105.3 |
| 4,833,756 | 5/1989 | Terlecke et al. | 16/95 D X |
| 4,999,874 | 3/1991 | White | 16/96 D X |

FOREIGN PATENT DOCUMENTS

| | | | |
|---|---|---|---|
| 562950 | 2/1923 | France | 211/105.1 |
| 100 | of 1898 | United Kingdom | 211/105.1 |
| 524813 | 1/1940 | United Kingdom | 211/105.1 |

*Primary Examiner*—Blair M. Johnson
*Assistant Examiner*—Korie Chan
*Attorney, Agent, or Firm*—Roger D. Emerson

[57] ABSTRACT

A drapery rod comprises a ductile wire stiffener which is plastically deformable by manually generated stresses. The ductile wire stiffener is surrounded by a solid cylindrical member made up of resiliently deformable material, such as polypropylene foam. The drapery rod can be plastically deformed to conform to unusually shaped windows, such as semicircles. The ends of the rod may be deformed to provide returns.

11 Claims, 5 Drawing Sheets

REINFORCED FOAM DRAPERY HARDWARE

BACKGROUND OF THE INVENTION

I. Field of Invention

This invention pertains generally to the art of structures to be mounted on interior walls for decorative purposes, and more specifically to drapery rods for hanging curtains and draperies near windows.

II. Description of Related Art

In the past, draperies have been hung from rods which were mounted to a wall near a window. Typically, these rods were made of metal and had a straight linear configuration.

Some newer window designs have featured nonrectangular window shapes. As such, a problem has been presented in that the straight drapery rods no longer corresponded to the window's shape. Drapery rods are difficult to form into non-linear shapes, such as semicircles. In addition, applicants recognized the need for a low cost drapery rod which would be adaptable to a variety of window configurations and provide excellent service and attractive appearance at an attractive cost.

The present invention contemplates a new and improved drapery rod which is simple in design, effective in use, and overcomes the foregoing difficulties and others while providing better and more advantageous overall results.

SUMMARY OF THE INVENTION

In accordance with the present invention, a new and improved drapery rod is provided which can be conformed to non-linear window shapes.

More particularly, in accordance with the invention, the drapery rod comprises a ductile wire plastically deformable by manually generated stresses. A solid cylindrical body member surrounds the wire.

According to one aspect of the invention, the body member comprises a resiliently deformable material.

According to another aspect of the invention, the body member is easily penetrable by associated pins.

According to another aspect of the invention, the body member comprises a smooth outer surface. In one embodiment, the smooth outer surface is made to resemble wood grain or painted or marbled surfaces.

According to another aspect of the invention, a fabric sheath surrounds the body member.

According to another aspect of the invention, the rod further comprises first and second ends which are selectively bendable to form returns.

According to another aspect of the invention, the drapery rod comprises a plurality of wires or tubes surrounded by the body member.

According to another aspect of the invention, the drapery rod comprises a ductile wire stiffener which is plastically deformable by manually generated stresses. A solid body member surrounds the wire. The body member comprises a resiliently deformable material which is selectively penetrable by associated pins. The wire stiffener is generally coincident with a longitudinal axis of the body member. The associated pins selectively secure the associated draperies to the drapery rod. The drapery rod is plastically deformed to generally follow the shape of the associated window with which the rod is to be used.

One advantage of the present invention is its ability to be manually deformed to conform to nonlinear window configurations.

Another advantage of the present invention is the ability to deform the ends to form returns. This limits the number of pieces required to form the drapery rod. In addition to the cost savings and inventory savings, it is easier to construct and use the present drapery rod in the field.

Another advantage of the present invention is its ability to be penetrable by pins. Draperies are easily attached to the drapery rod by simply pinning them with a common straight pin. Adjustments to drapery position can be made easily by novices.

Another advantage of the present invention is its low manufacturing cost and the variety of colors and decorative effects which can by molded into or laminated onto the body member.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein.

DESCRIPTION OF THE PREFERRED EMBODIMENT

Figure 1:
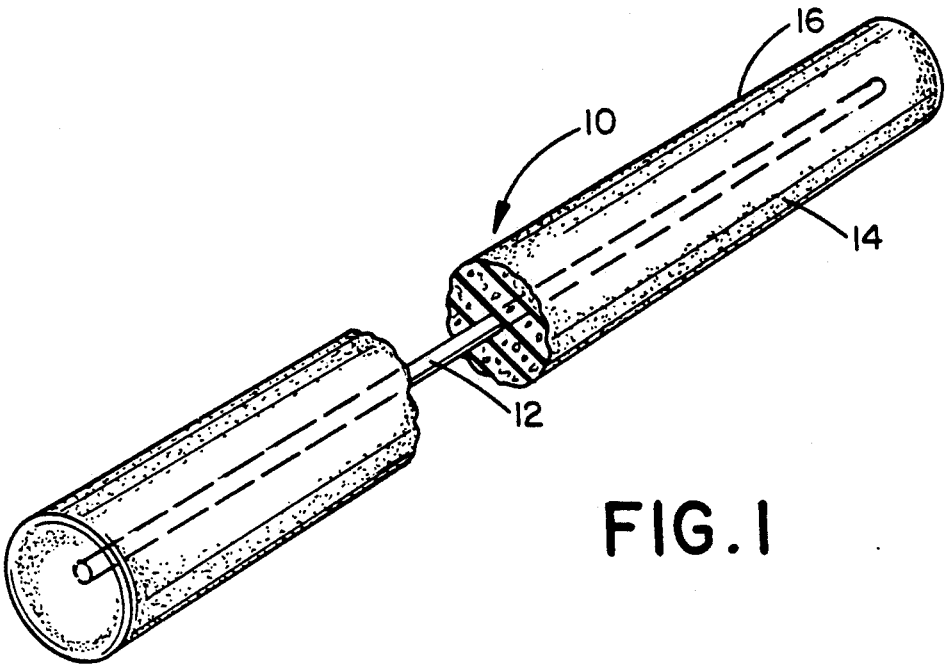
FIG. 1 is a perspective view of an undeformed drapery rod according to the invention wherein the middle portion of the body member is broken away to show the ductile wire stiffener.
Figure 11:
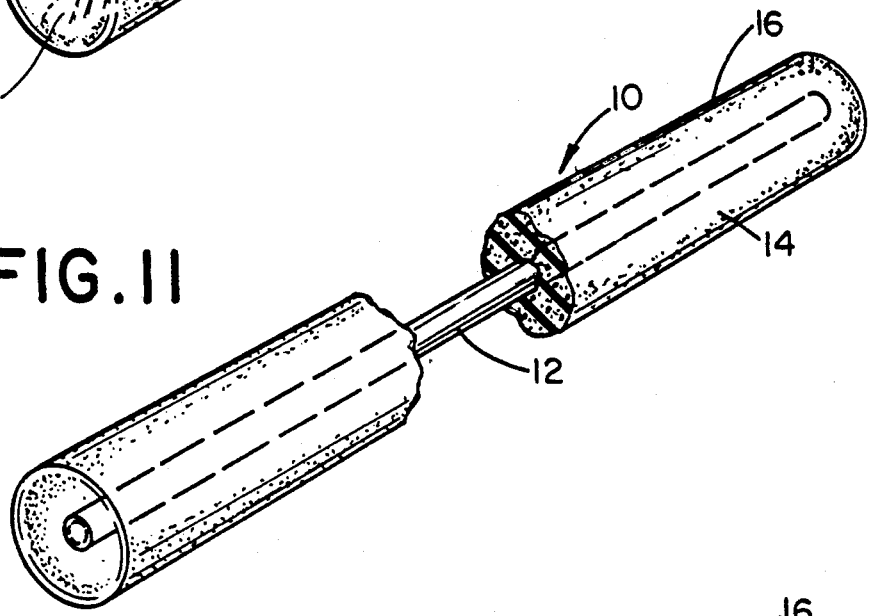
FIG. 11 is a perspective view of a drapery rod according to the invention featuring a tubular wire stiffener; and, FIG. 12 is a perspective view of a drapery rod according to the invention featuring a tubular wire stiffener surrounded by a spring.
Figure 12:
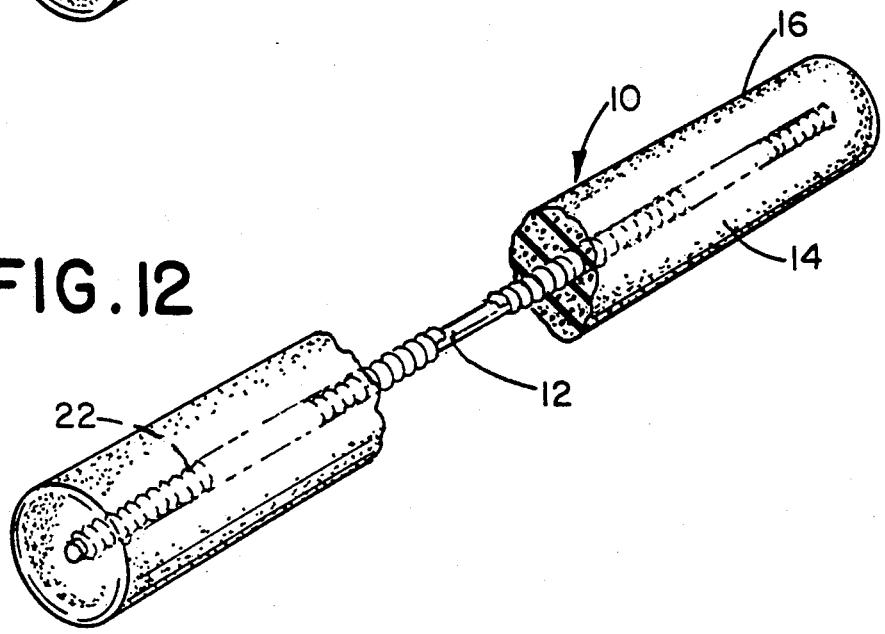

Referring now to the drawings, which are for purposes of illustrating a preferred embodiment of the invention only, and not for purposes of limiting the invention, FIG. 1 shows a drapery rod 10 according to the present invention. The drapery rod 10 comprises a wire 12 which acts as a stiffener. In some applications, the wire 12 is rigid and is used in straight linear orientation. In these applications, the wire 12 is stiff and not necessarily bendable by manually-generated stresses. In the preferred embodiment, the wire 12 is ductile and easily plastically deformable by manually-generated stresses, such as will be discussed later in this disclosure. In another embodiment, the wire 12 can be tubular in configuration, as disclosed in FIG. 11. With reference to FIG. 12, another embodiment features a stiffener 12 which is tubular and surrounded by a spring 22. The spring 22 helps secure the stiffener 12 within the body member 14. The drapery rod 10 also comprises a body member 14 which has a solid, cylindrical, column-like configuration and surrounds the ductile wire 12. In several of the FIGURES, the body member 14 is broken away in the middle of the rod 10 to show the wire 12.

In the preferred embodiment, the wire 12 should be of such composition and dimension so as to be plastically deformable into the desired shape. In the preferred embodiment, the wire 12 is manually deformable by stresses generated by a person's hands, such as by the user of the drapery rod 10 at the point of use.

The body member 14 is made of a resiliently deformable material to retain a generally cylindrical, column-like, aesthetically pleasing shape. When the diameter of the body member 14 exceeds about 3 inches, it is sometimes preferable to mold the body member 14 into a "D" shape. In this configuration, the flattened portion of the body member 14 is oriented adjacent a wall upon which the rod 10 will be mounted. In the preferred embodiment, the body member 14 is made of polypropylene foam, although other types of foam or foamed agents can be used. In the preferred manufacturing method, the polypropylene body member 14 is extruded around the wire 12. Another embodiment is manufactured by extruding the body member 14 and then inserting the wire 12 through the center of the body member 14.

In one preferred embodiment, the exterior surface 16 of the body member 14 has a smooth texture. This smooth texture has several advantages. First, the smooth surface is aesthetically pleasing. Second, the smooth surface is conducive to the addition of certain outward decorative treatments, such a wood grain appearance simulating a real wood column. Other decorative treatments are simulated marble finishes or painted finishes. Third, the smooth exterior surface 16 facilitates the insertion of the drapery rod 10 within a fabric sleeve, which will be discussed later in this specification.

Figure 2:
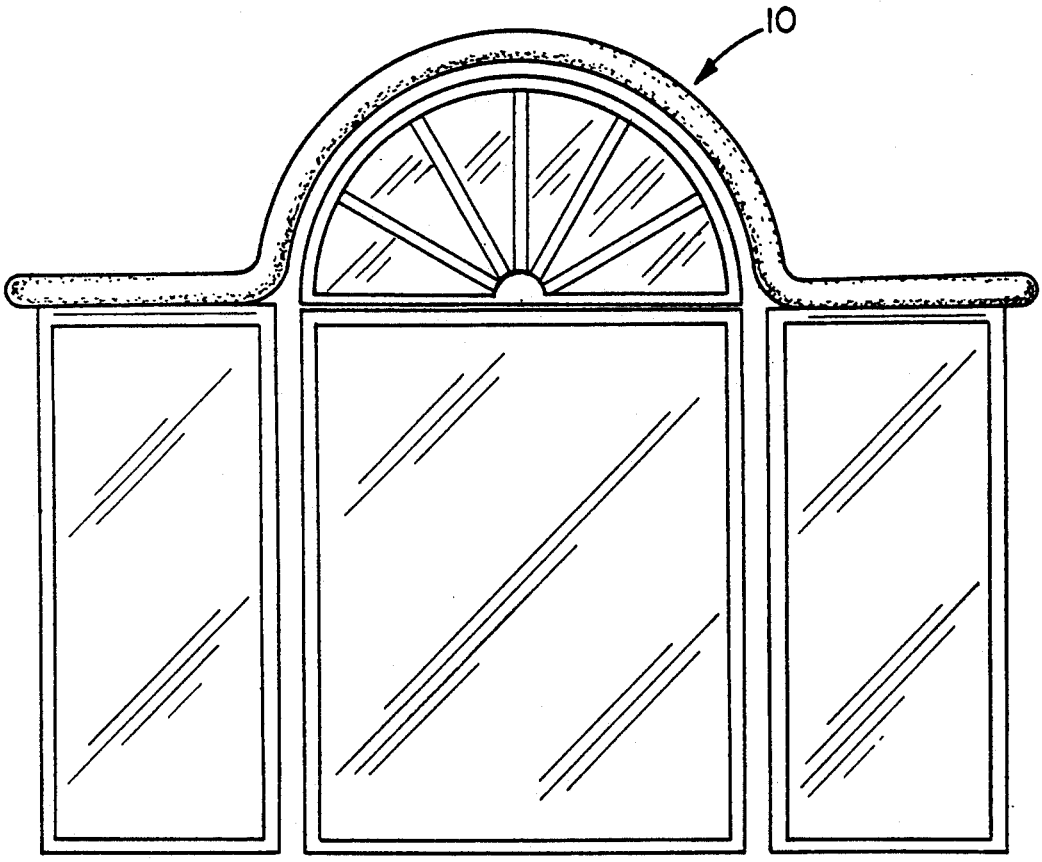
FIG. 2 is a typical window application wherein a non-linear drapery rod is required.

With reference to FIG. 2, one typical nonrectangular application for the drapery rod 10 is shown. Typically, prior art drapery rods were linear, presenting a significant problem for designers facing such non-rectangular applications. The drapery rod 10 of the present invention is easily deformable to conform to unusually-shaped windows, such as the semicircular window shown in FIG. 2.

Figure 3:
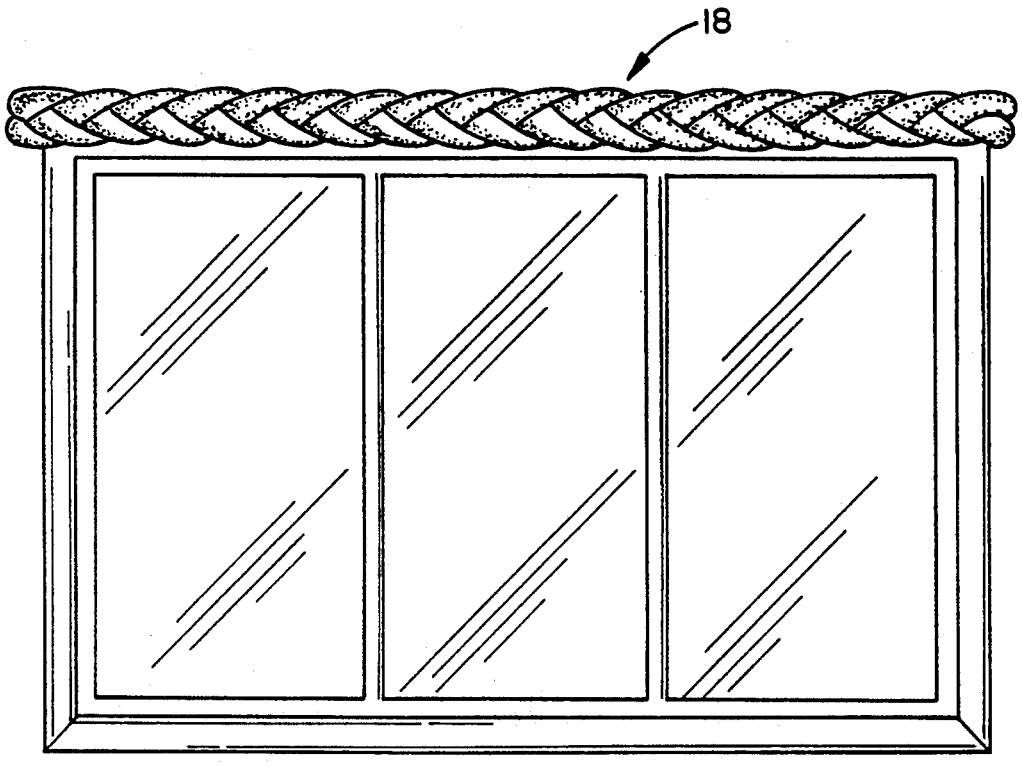
FIG. 3 is another embodiment of the invention wherein three drapery rods are braided into a single composite drapery rod.

With reference to FIG. 3, another application of the present invention drapery rod 10 is shown. In this application, three drapery rods 10 have been braided into a single composite rod 18. Drapery rods 10 can also be woven and twisted together to meet various personal preferences of the designer.

Figure 5:
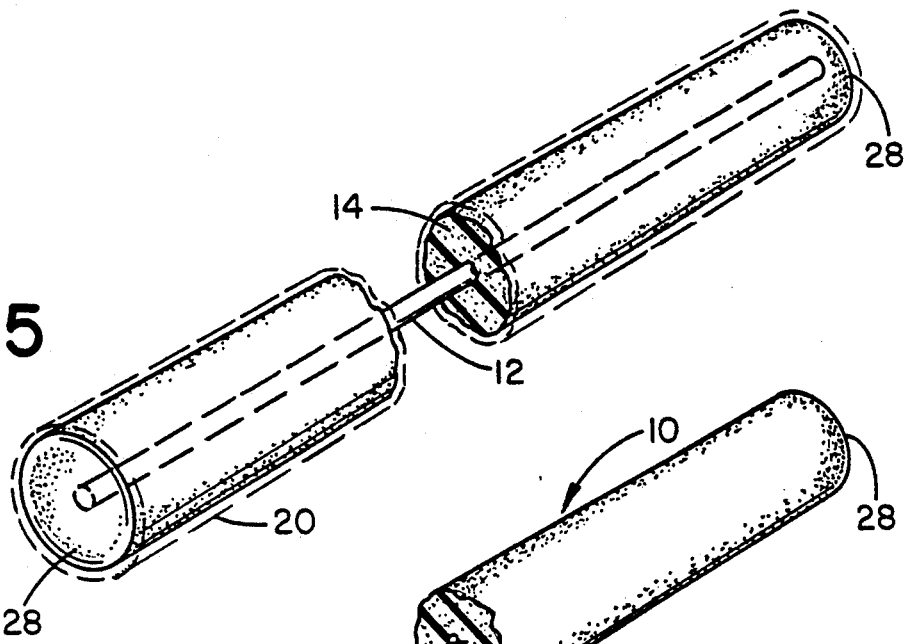
FIG. 5 is a perspective view of a drapery rod which has been covered with a fabric sheet. The fabric sheet is shown in hidden lines. A portion of the sheet and the body member have been broken away to show the ductile wire stiffener.
Figure 6:
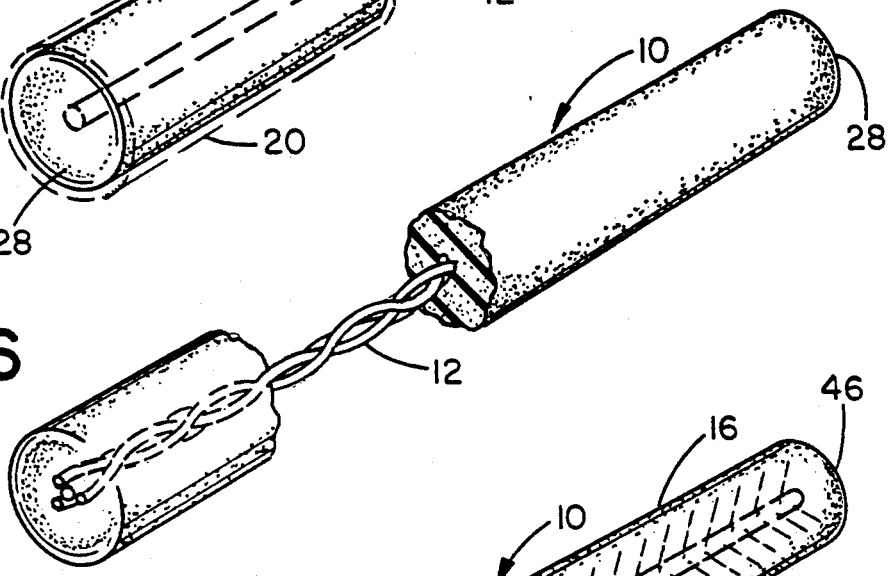
FIG. 6 is a perspective view of a drapery rod wherein the body member has been broken away to show a plurality of ductile wire stiffeners.

With reference to FIG. 5, according to one embodiment of the present invention, the rod 10 is enclosed within a fabric sheath 20. The designer can choose fabric sheaths 20 according to the specific design objectives for the specific application. With reference to FIGS. 3 and 6, different fabric sheaths may be combined on different individual drapery rods to provide various composite rods 18. The resiliently deformable nature of the fabric sheath 20 helps in the insertion of the rod 10 within the sheath 20. The body member 14 is compressed to fit within fabric sheath 20. When the body member 14 is allowed to relax and expand, Wrinkles in the fabric sheath 20 are smoothed.

Figure 4:
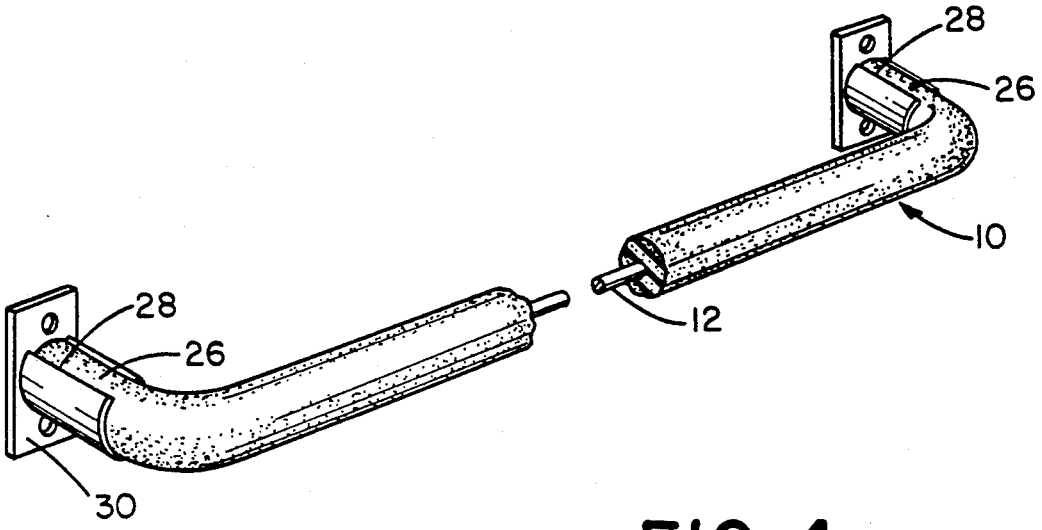
FIG. 4 is a perspective view of a drapery rod wherein the ends have been bent to form returns.

With reference to FIG. 4, another significant advantage of the present drapery rod 10 is its ability to form its own returns 26. Typically, the prior art drapery rod required a separate piece to be attached to the drapery rod at right angles to the rod at each of its ends. This extra piece, called a return, attached the drapery rod to the wall at a desired offset. In the present invention, because it is manually deformable, the designer is able at the point of use to form a return 26 simply by bending the ends 28 at the appropriate location along the rod 10. These returns 26 can be fitted into any appropriate mounting system attached to the wall, such as the typical brackets 30 shown in FIG. 4.

With reference to FIG. 6, according to one embodiment of the present invention, a plurality of wires 12 comprise the wire stiffener. Such an embodiment might be of advantage if the draperies to be hung were of considerable weight. In the alternative, a stronger wire might be used. The specific design to be used will depend on the individual application.

Figure 7:
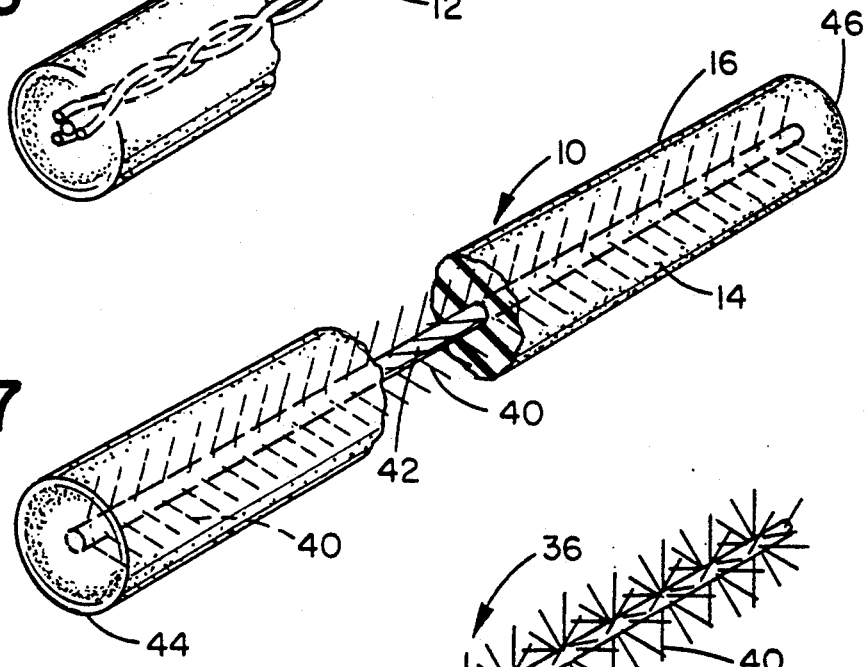
FIG. 7 is a perspective view of a drapery rod according to one embodiment of the invention.
Figure 8:
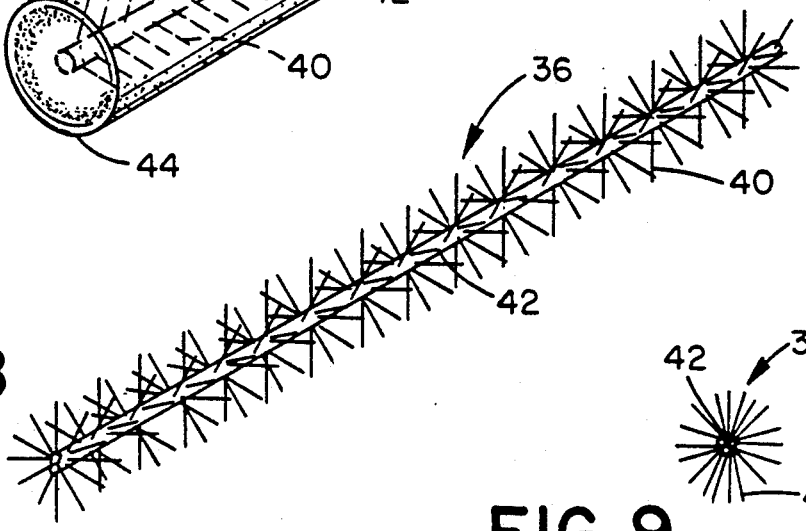
FIG. 8 is a perspective view of a ductile wire stiffener according to one embodiment of the invention.
Figure 9:
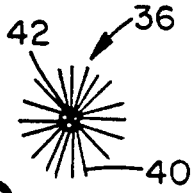
FIG. 9 is an end view of the ductile wire stiffener of FIG. 8.

With reference to FIGS. 8 and 9, another embodiment of wire stiffener is disclosed. In this embodiment, the stiffener comprises a wire brush member 36 having bristles 40 extending outwardly from a center wire 42. If the body member 14 is extruded around such a wire brush member 36, the bristles 40 tend to secure the wire brush member 36 within the rod 10. With reference to FIG. 7, if the wire brush member 36 is inserted into an already extruded body member 14, the bristles tend to deform backwardly. For example, with continuing reference to FIG. 7, in the embodiment shown, the wire brush member 36 was inserted first into end 46 and pushed toward end 44. As such, the bristles 40 are deformed backwardly toward end 46.

Figure 10:
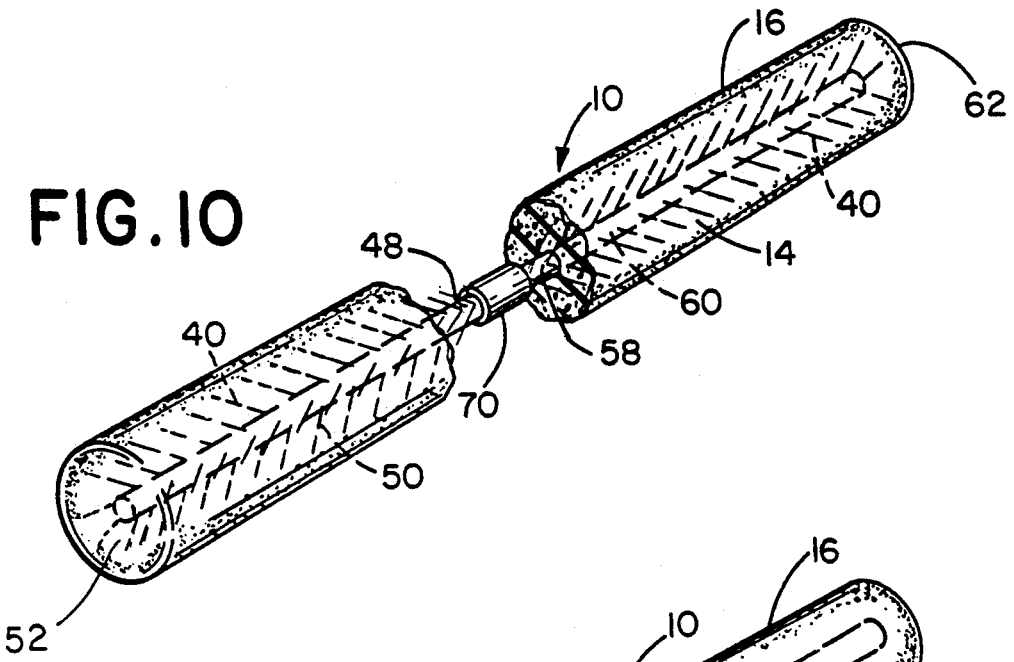
FIG. 10 is a perspective view of another embodiment of a drapery rod according to the invention wherein the body member has been broken away to show a coupling.

With reference to FIG. 10, another embodiment of the invention is disclosed. In the embodiment disclosed in FIG. 10, a first end 48 of a first wire stiffener 50 has been inserted into a first end 52 of a body member 14. Because the first wire stiffener 50 used in this application features bristles 40, the bristles have been deformed backwardly upon insertion. In some applications, the residual stresses in the bristles 40 may cause certain undesirable effects. In other cases, due to the length of the rod 10 required, it may be difficult to insert the first wire stiffener 50 through a long length of body member 14. For these reasons, it is sometimes helpful to insert a first end 58 of a second wire stiffener 60 into a second end 62 of the body member 14. Upon insertion of the second wire stiffener 60, the bristles 40 of the second wire 60 deform in an opposite direction to the bristles 40 of the first wire stiffener 50. The first end 48 of the first wire stiffener 50 and the first end 58 of the second wire stiffener 60 are joined in the middle of the rod via coupling means 70. In the preferred embodiment, the coupling means is simply a mechanism which receives the first end 48 of the first wire stiffener 50 and the first end 58 of the second wire stiffener 60 and joins them together. The coupling 70 is easily inserted Within the body member 14 by affixing it to either of the first ends 48, 58 of the wire stiffeners 50, 60.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

Figure 13:
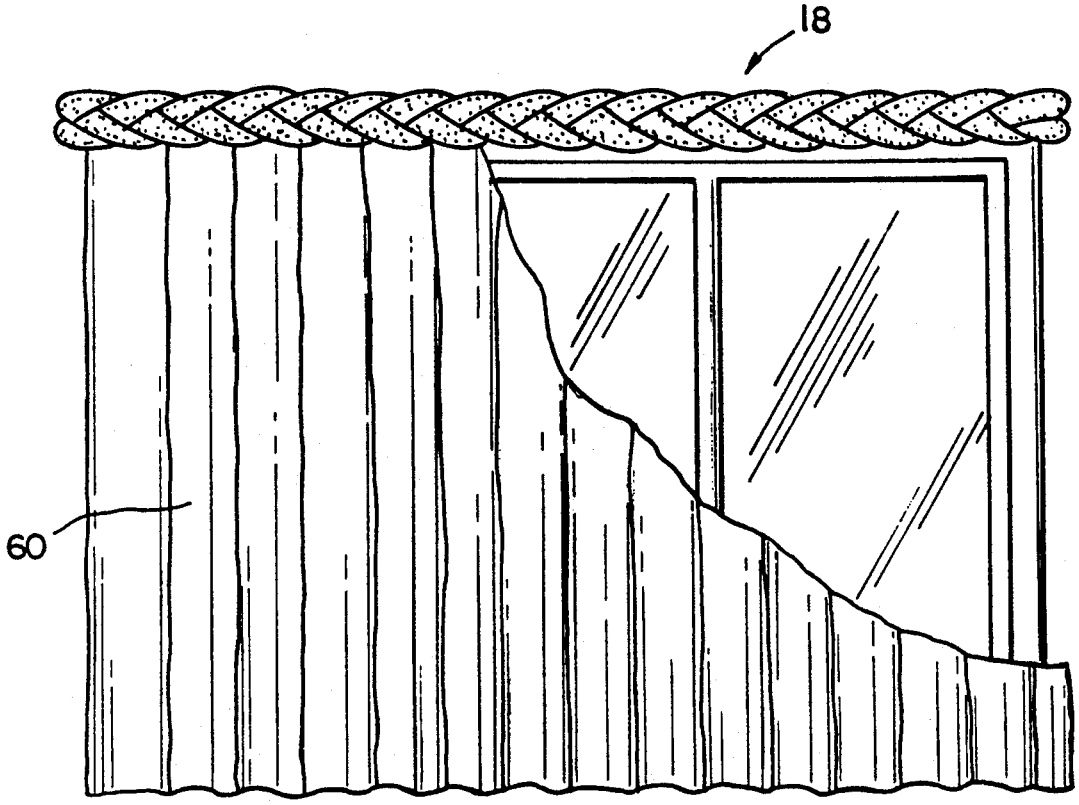
FIG. 13 is an enlarged view of the invention as shown in FIG. 3 shown with a drapery partially broken away, illustrating how draperies can be hung from the invention via the use of pins; and, FIG. 14 is a perspective view of a drapery rod according to the invention wherein the drapery is shown in broken lines and the rod has been partially broken away to show how draperies can be affixed to the rod via pins.
Figure 14:
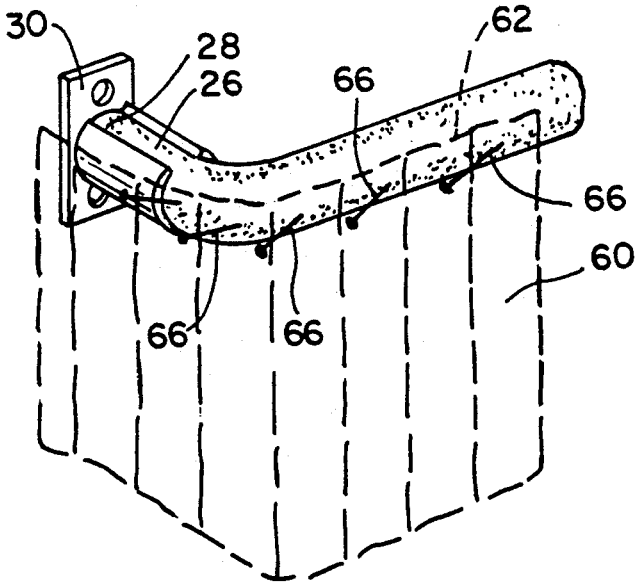

With reference to FIG. 13, a drapery 60 as would be commonly hung from the drapery rod 10 is shown. In FIG. 13, the top edge of the draper is pinned to the back surface of the composite rod 18 with pins (not shown). With reference to FIG. 14, an embodiment of the invention is shown in which the top edge 62 of the drapery 60 is pinned to the rod 10 by pins 66. The pins 66 have a length which can be received into the body member 14 of the rod 10.

What is claimed is:

1. A drapery rod for hanging draperies therefrom, the draperies hung from said rod via pins, the pins having a length, said drapery rod comprising:

a ductile wire, said wire being plastically deformable by manually generated stresses while having sufficient rigidity to support the draperies, said wire having an outer surface, a length, and a longitudinal axis; and a body member made of resilient foam, said body member having an inner and an outer surface, said inner surface of said body member surrounding and affixed to said wire so that said inner surface of said body member is coincident with said outer surface of said wire along its entire length, said body member being generally coaxial with said wire, said body member being generally cylindrical and having a diameter, said diameter being at least 1.5 inches, said body member being resiliently deformable, said rod and body member further comprising first and second ends, said ends selectively bent at right angles to said axis of said drapery rod to form returns, said first and second ends adapted to affix said drapery rod a certain distance from a wall.

2. The drapery rod of claim 1 wherein said resilient foam of said body member is plastic foam.

3. The drapery rod of claim 2 wherein said body member further comprises:

a smooth outer surface, said smooth outer surface adapted to resemble wood grain.

4. The drapery rod of claim 2 wherein said body member further comprises:

a smooth outer surface, said smooth outer surface adapted to resemble marble.

5. The drapery rod of claim 2 wherein said body member further comprises:

a smooth outer surface, said smooth outer surface having a decorative design.

6. The drapery rod of claim 1 further comprising:

a fabric sheath surrounding said body member.

7. The drapery rod of claim 1 further comprising:

a plurality of wires surrounded by said body member, said plurality of wires being helically wound about each other.

8. The drapery rod of claim 1 further comprising:

a plurality of wires surrounded by said body member, said plurality of wires being braided about each other.

9. The drapery rod of claim 1 wherein said resilient foam of said body member is polypropylene foam.

10. The drapery rod of claim 1 wherein said wire further comprises:

bristles extending axially outwardly from said wire.

11. A drapery system for hanging draperies, the draperies hung from a rod via pins, said drapery system comprising:

draperies;

pins, said pins having a length; and a rod, said rod comprising a stiffener being plastically deformable by manually generated stresses, said stiffener having a longitudinal axis, said rod further comprising a body member affixed to and surrounding said stiffener and being generally coaxial therewith, said body member comprising plastic foam, said body member having a smooth outer surface and a thickness sufficient to receive said entire length of said pins, said body member being resiliently deformable and adapted to be easily penetratable by said pins, said entire length of said pins being selectively received into said body member and securing said draperies thereto.

* * * * *